US012624907B2

(12) United States Patent
Mason et al.

(10) Patent No.: US 12,624,907 B2
(45) Date of Patent: May 12, 2026

(54) METHODS, DEVICES, AND SYSTEMS FOR CONTROL OF HEAT TRANSFER USING SPIN CROSSOVER

(71) Applicant: President and Fellows of Harvard College, Cambridge, MA (US)

(72) Inventors: Jarad A. Mason, Cambridge, MA (US); Jinyoung Seo, Cambridge, MA (US); Ryan McGillicuddy, Cambridge, MA (US); Jason Braun, Cambridge, MA (US); Rahil Ukani, Cambridge, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 118 days.

(21) Appl. No.: 18/687,928

(22) PCT Filed: Aug. 30, 2022

(86) PCT No.: PCT/US2022/042033
§ 371 (c)(1),
(2) Date: Feb. 29, 2024

(87) PCT Pub. No.: WO2023/034297
PCT Pub. Date: Mar. 9, 2023

(65) Prior Publication Data

US 2024/0393067 A1 Nov. 28, 2024

Related U.S. Application Data

(60) Provisional application No. 63/238,629, filed on Aug. 30, 2021.

(51) Int. Cl.
*F28F 13/00* (2006.01)

(52) U.S. Cl.
CPC ..... *F28F 13/00* (2013.01); *F28F 2013/008* (2013.01)

(58) Field of Classification Search
CPC .. F28D 20/00; F28D 20/02; F28F 7/00; F28F 13/00
See application file for complete search history.

(56) References Cited

U.S. PATENT DOCUMENTS

2013/0214179 A1* 8/2013 Letard ..... H10D 48/385 250/492.1
2015/0168507 A1* 6/2015 Terki ..... G01R 33/096 324/251

(Continued)

OTHER PUBLICATIONS

Gaspar et al., "Pressure effect investigations on spin-crossover coordination compounds," Comptes Rendus Chimie 21, 1095-1120 (Oct. 2018).

(Continued)

*Primary Examiner* — Eric S Ruppert
*Assistant Examiner* — Hans R Weiland
(74) *Attorney, Agent, or Firm* — Clark & Elbing LLP

(57) ABSTRACT

The invention provides methods, devices, and systems for applications requiring control of heat transfer, such as thermal management of electronic device, cooling, heating, and energy storage. The invention provides a method of controlling the flow of heat by providing a device including a spin crossover material having a low spin state and a high spin state, where the low spin state has higher thermal conductivity than the high spin state, and where the spin crossover material undergoes spin crossover between the low and high spin states in response to a stimulus.

23 Claims, 5 Drawing Sheets

(56) References Cited

U.S. PATENT DOCUMENTS

| | | | | |
|---|---|---|---|---|
| 2016/0112050 | A1* | 4/2016 | Gotsmann | F28F 13/00 331/66 |
| 2017/0054183 | A1* | 2/2017 | Kato | H01M 10/0525 |
| 2018/0179241 | A1* | 6/2018 | Frank | H10N 70/841 |

OTHER PUBLICATIONS

Henry et al., "High Thermal Conductivity of Single Polyethylene Chains Using Molecular Dynamics Simulations," Phys Rev Lett. 101, 235502-4 (Dec. 2008).
Hsieh et al., "Effects of iron on the lattice thermal conductivity of Earth's deep mantle and implications for mantle dynamics" Proc Natl Acad Sci USA. 115:16, 4099-4104 (Apr. 2018).
Klinar et al., "Thermal control elements for caloric energy conversion," Renewable and Sustainable Energy Reviews. 118: 109571 (Feb. 2020).
Létard, "Photomagnetism of iron(ii) spin crossover complexes—the T(LIESST) approach," J. Mater. Chem. 16, 2550-2559 (2006).
Marcondes et al., "Phonon dispersion throughout the iron spin crossover in ferropericlase," Phys Rev. B 102:104112 (Sep. 2020).
Mikolasek et al., "Complete Set of Elastic Moduli of a Spin-Crossover Solid: Spin-State Dependence and Mechanical Actuation," J. Am. Chem. Soc. 140(28) 8970-8979 (2018).
Molnár et al., "Molecular Spin Crossover Materials: Review of the Lattice Dynamical Properties," Annalen Der Physik. 531:10, 1900076 (Aug. 2019).
Morton et al., "Effect of Iron Impurities on the Thermal Conductivity of Magnesium Oxide Single Crystals below Room Temperature" Phys Rev. B 3:2, 552 (Jan. 1971).
Palii et al., "Microscopic theory of cooperative spin crossover: Interaction of molecular modes with phonons," J. Chem. Phys. 143(8), 084502 (Aug. 2015).
Quintero et al., "Hybrid spin-crossover nanostructures," Beilstein J. Nanotechnol. 5, 2230-2239 (Nov. 2014).
Ridier et al., "Spatiotemporal dynamics of the spin transition in [Fe(HB(tz)3)2] single crystals" Phys Rev. B 96, 134106-10 (Oct. 2017).
Roubeau, "Triazole-based one-dimensional spin-crossover coordination polymers," Chemistry—A European Journal. Nov. 26, 2012;18(48):15230-44.
Shen et al., "Polyethylene nanofibres with very high thermal conductivities," Nature Nanotech. 5, 251-5 (Apr. 2010).
Swoboda et al., "Solid State Thermal Control Devices," Adv Electron Matter. 7,2000625: 28 (Nov. 2020).
Wehmeyer et al., "Thermal diodes, regulators, and switches: Physical mechanism and potential applications," Applied Physics Reviews. 4, 041304 (2017).
Wu et al., "Elastic Anomalies in a Spin-Crossover System: Ferropericlase at Lower Mantle Conditions" Phys Rev Lett. 110, 228501 (May 2013).
Xu et al., "Nanostructured polymer films with metal-like thermal conductivity," Nature Communications. 10(1771): 8 (2019).

* cited by examiner

METHODS, DEVICES, AND SYSTEMS FOR CONTROL OF HEAT TRANSFER USING SPIN CROSSOVER

BACKGROUND OF THE INVENTION

High-performance thermal devices that enable high-contrast, reversible, and active control of heat transfer, such as thermal switches, regulators, and diodes, can be highly beneficial for a wide range of modern technologies, such as thermal management of electronic devices, thermoelectric energy harvesting, and solid-state caloric cooling. To date, a number of mechanisms have been utilized to realize control of thermal transport in materials. Examples include magnetic field-induced switching of molecular orientation in liquid crystals, electric field-induced manipulation of ferroelastic domains in $Pb[Zr_xTi_{1-x}]O_3$ thin films, hydration-dehydration in soft materials, light-induced modulation of chain alignment in azobenzene polymers, and order-disorder phase transitions. However, these systems often exhibit a modest conductivity switching ratio ($k_{high}/k_{low}$) or low overall conductivities; in addition, the synthetic manipulations required to establish structure-property relationships, e.g., those critical to rationally designing thermal devices, are difficult.

Thus, there is a need for new methods, devices, and systems for thermal switching.

SUMMARY OF THE INVENTION

The invention provides methods, compositions, and systems for solid state heat flow control (e.g., thermal switches and regulators), e.g., with applications in, e.g., cooling, heating, and energy storage.

In one aspect, the invention provides a method of controlling the flow of heat by providing a device including a spin crossover material having a low spin state and a high spin state, where the low spin state has higher thermal conductivity than the high spin state, and where the spin crossover material undergoes spin crossover between the low and high spin states in response to a stimulus. The method further includes providing a temperature difference across the spin crossover material and applying the stimulus to control the flow of heat across the material.

In some embodiments, the stimulus applied is a pressure change, a temperature change, light, a magnetic field, an electric field, or any combination thereof. In some embodiments, the method further includes increasing or decreasing a temperature of the spin crossover material to a temperature at which the spin crossover material undergoes spin crossover. In some embodiments, the method further includes maintaining the low spin state by applying a first pressure while providing the temperature difference to allow heat to flow across the spin crossover material and applying a second pressure which allows the spin crossover material to undergo spin crossover to the high spin state to reduce heat flow across the spin crossover material. In some embodiments, the method further includes applying a second stimulus to change the spin crossover material to the low spin state. In some embodiments, the stimulus is temperature, and the spin crossover material allows or resists the flow of heat after a pre-determined temperature has been reached, either by cooling or heating.

In another aspect, the invention provides a method of storing heat energy. The method includes providing a device including a spin crossover material having a low spin state and a high spin state, where the low spin state has higher thermal conductivity than the high spin state. The material undergoes spin crossover between the low spin state and the high spin state in response to a first stimulus and from the high spin state to the low spin state in response to a second stimulus. The device further includes a heat sink in thermal contact with the spin crossover material. The method further includes flowing heat energy from a heat source through the spin crossover material into the heat sink while the spin crossover material is in the low spin state, applying the first stimulus to switch the material to the high spin state to store the heat energy. In some embodiments, the method includes applying the second stimulus to switch the spin crossover material to the low spin state thereby releasing the heat energy.

In some embodiments, the first stimulus and/or second stimulus is a pressure change, a temperature change, light, or any combination thereof. In some embodiments, the method further includes increasing or decreasing a temperature of the spin crossover material to a temperature at which the spin crossover material undergoes spin crossover. In some embodiments, the method further includes maintaining the low spin state by applying a first pressure to allow heat to flow across the spin crossover material. In some embodiments, the method further includes applying a second pressure which allows the spin crossover material to undergo spin crossover to the high spin state.

In another aspect, the invention provides a method of heating or cooling employing a spin crossover material. The method includes providing heat energy to a caloric material through a spin crossover material having a low spin state and a high spin state, where the low spin state has higher thermal conductivity than the high spin state, and where the material undergoes spin crossover between the low spin state and the high spin state in response to a first stimulus and between the high spin state and low spin state in response to a second stimulus. Heat energy is either provided or removed while the spin crossover material is in the low spin state. The method further includes applying the first stimulus to switch the material to the high spin state. The method further includes inducing the caloric material to release the heat energy. The method further includes applying a second stimulus to the spin crossover material to change to the low spin state.

In some embodiments, the first stimulus and/or second stimulus is a pressure change, a temperature change, light, or any combination thereof. In some embodiments, the first or second stimulus is a temperature change, e.g., where the method includes increasing or decreasing a temperature of the spin crossover material to a temperature at which the spin crossover material undergoes spin crossover. In some embodiments, the method further includes maintaining the low spin state by applying a first pressure while providing a temperature difference to allow heat to flow across the spin crossover material. In some embodiments, the method further includes applying a second pressure which allows the spin crossover material to undergo spin crossover to the high spin state.

In another aspect, the invention provides a device for controlling heat flow. The device includes a spin crossover material having a low spin state and a high spin state, where the low spin state has higher thermal conductivity than the high spin state, and where the spin crossover material undergoes spin crossover between the low spin state and the high spin state in response to a first stimulus.

In some embodiments, the first stimulus is selected from a pressure change, a temperature change, light, or any combination thereof. In some embodiments, the spin crossover induced by the first stimulus can be reversed by a second stimulus. In some embodiments, the first stimulus and second stimulus are the same type of energy. Alternatively, the first stimulus and second stimulus are different types of energy.

In some embodiments, the spin crossover material includes a transition metal coordination complex. In some embodiments, the transition metal coordination complex includes Co(ii), Co(iii) Fe(ii), Fe(iii), Ni(ii), Mn(ii), Mn(iii), Cr(ii), Pd(ii), Pt(ii), Au(i), Ag(i), Cu(ii), or a combination thereof. In some embodiments, the spin crossover material includes a molecular transition metal complex or a 1-D, 2-D, or 3-D polymeric transition metal complex. In some embodiments, the 1-D polymeric transition metal complex includes bridging triazole ligands. In some embodiments, the spin crossover material includes 1-D polymeric $[Fe(R\text{-}Trz)_3][A]_2$, where R-Trz is a triazole ligand with an R group, where each R group is independently H, an optionally substituted hydrocarbyl (e.g., alkyl) group, an optionally substituted aryl, an optionally substituted carbocyclyl group, or an optionally substituted heteroaryl group (e.g., an optionally substituted alkyl group, an optionally substituted aryl, an optionally substituted carbocyclyl group, or an optionally substituted heteroaryl group), and A is an anion or combination of anions. In some embodiments, the spin crossover material is bis[hydrotris(1,2,4-triazol-1-yl)borate] iron(II) ($Fe(HB(tz)_3)_2$).

Another aspect of the invention provides a system including a spin crossover material as described herein.

Definitions

The term "about," as used herein, refers to ±10% of a recited value.

The term "hydrocarbyl," as used herein, is meant straight chain or branched saturated groups of carbons. Exemplary hydrocarbyl groups include alkyl (saturated), alkenyl (unsaturated with at least one carbon double bond and no carbon triple bonds), and alkynyl (unsaturated with at least one carbon triple bond). Alkyl groups are exemplified by n-, sec-, iso- and tert-butyl, neopentyl, nonyl, decyl, and the like, and may be optionally substituted with one or more, substituents. Hydrocarbyl groups of the invention may include >4 carbon atoms, e.g., 6-15, such as 8-12, in the main chain. Carbon atoms in the main chain may be interrupted with one or more heteroatoms, e.g., O, S, or N.

By "aryl" is meant an aromatic cyclic group in which the ring atoms are all carbon. Exemplary aryl groups include phenyl, naphthyl, and anthracenyl. Aryl groups may be optionally substituted with one or more substituents.

By "carbocyclyl" is meant a non-aromatic cyclic group in which the ring atoms are all carbon. Exemplary carbocyclyl groups include cyclopropyl, cyclobutyl, cyclopentyl, cyclohexyl, cycloheptyl, and cyclooctyl. Carbocyclyl groups may be optionally substituted with one or more substituents. A carbocyclyl group may or may not be saturated.

By "halo" is meant, fluoro, chloro, bromo, or iodo.

By "heteroaryl" is meant an aromatic cyclic group in which the ring atoms include at least one carbon and at least one O, N, or S atom, provided that at least three ring atoms are present. Exemplary heteroaryl groups include oxazolyl, isoxazolyl, tetrazolyl, pyridyl, thienyl, furyl, pyrrolyl, imidazolyl, pyrimidinyl, thiazolyl, indolyl, quinolinyl, isoquinolinyl, benzofuryl, benzothienyl, pyrazolyl, pyrazinyl, pyridazinyl, isothiazolyl, benzimidazolyl, benzothiazolyl, benzoxazolyl, oxadiazolyl, thiadiazolyl, and triazolyl. Heteroaryl groups may be optionally substituted with one or more substituents.

By "heterocyclyl" is meant a non-aromatic cyclic group in which the ring atoms include at least one carbon and at least one O, N, or S atom, provided that at least three ring atoms are present. Exemplary heterocyclyl groups include epoxide, thiiranyl, aziridinyl, azetidinyl, thietanyl, dioxetanyl, morpholinyl, thiomorpholinyl, piperazinyl, piperidinyl, pyrrolidinyl, tetrahydropyranyl, tetrahydrofuranyl, dihydrofuranyl, tetrahydrothienyl, dihydrothienyl, dihydroindolyl, tetrahydroquinolyl, tetrahydroisoquinolyl, pyranyl, pyrazolinyl, pyrazolidinyl, dihydropyranyl, tetrahydroquinolyl, imidazolinyl, imidazolidinyl, pyrrolinyl, oxazolidinyl, isoxazolidinyl, thiazolidinyl, isothiazolidinyl, dithiazolyl, and 1,3-dioxanyl. Heterocyclyl groups may be optionally substituted with one or more substituents.

Optional substituents include halo, optionally substituted $C_{3-10}$ carbocyclyl; optionally substituted $C_{1-9}$ heterocyclyl having one to four heteroatoms independently selected from O, N, and S; optionally substituted $C_{6-20}$ aryl; optionally substituted $C_{1-9}$ heteroaryl having one to four heteroatoms independently selected from O, N, and S; —CN; $—NO_2$; $—OR_a$; $—N(R_a)_2$; $—C(=O)R_a$; $—C(=O)OR_a$; $—S(=O)_2R_a$; $—S(=O)_2OR_a$; $—P(=O)R_{a2}$; $—O—P(=O)(OR_a)_2$, or $—P(=O)(OR_a)_2$, or an ion thereof; wherein each $R_a$ is independently H, optionally substituted $C_{1-6}$ hydrocarbyl (e.g., alkyl); optionally substituted $C_{3-10}$ carbocyclyl; optionally substituted $C_{1-9}$ heterocyclyl having one to four heteroatoms independently selected from O, N, and S; optionally substituted $C_{6-20}$ aryl; or optionally substituted $C_{1-9}$ heteroaryl having one to four heteroatoms independently selected from O, N, and S. Cyclic groups may also be substituted with hydrocarbyl (e.g., alkyl) groups.

BRIEF DESCRIPTION OF THE DRAWINGS

FIG. 4A shows the measured and fitted frequency-domain thermal reflectance (FDTR) curves for crystalline $Fe(HB(tz)_3)_2$ at room temperature (LS) and 80° C. (HS). Dashed lines show calculated FDTR curves with thermal conductivity deviation of ±20% of the fitted values. FIG. 4B shows thermal conductivity of crystalline $Fe(HB(tz)_3)_2$ with varying temperature. The datapoints show 4-point average of the crystal at each temperature. The error bars indicate the experimental uncertainty of thermal conductivity calculated with 5% uncertainties in the transducer thickness, heat capacity and beam radius. The effective heat capacity per unit volume of $Fe(HB(tz)_3)_2$ was determined by subtracting the endothermic peak from the specific heat measured by differential scanning calorimetry (DSC). The phase transition kinetics is much slower than the FDTR modulation frequency, and thus was not captured by FTDR measurements.

DETAILED DESCRIPTION OF THE INVENTION

The invention provides methods, devices, and systems for controlling heat flow using materials that undergo spin crossover (SCO) to a spin state with different thermal properties in response to stimuli.

Spin Crossover Materials

Figure 1:
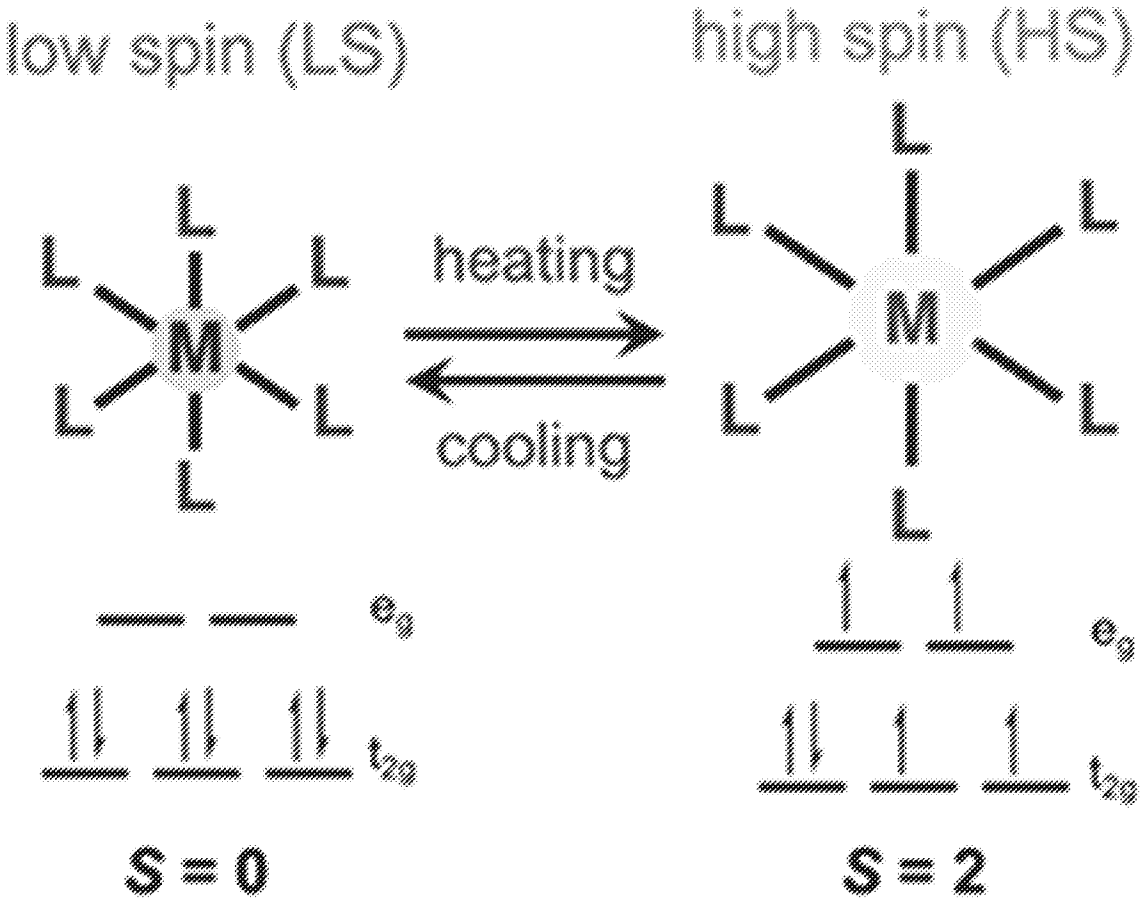
FIG. 1 is an illustration of the process of thermally-induced spin crossover in a transition metal complex.

Spin crossover, wherein the spin state of metal complexes changes due to external stimuli (e.g., temperature, pressure, and light), give rise to intricate couplings between electronic structures and lattice dynamical properties. Spin crossover transitions are commonly observed in first-row transition metal complexes with $d^4$-$d^7$ electron configuration in octahedral ligand field and can be directly controlled by manipulating coordination environments (see, e.g., FIG. 1). In SCO metal complexes, an increase in temperature can induce a transition from low-spin (LS) state to high-spin (HS) state. Such thermally induced SCO transitions are entropically driven because LS-to-HS transitions are accompanied by a large increase in vibrational entropy in the HS state. This mechanism, due to its highly tunable properties, has applications in a wide range of functional materials and devices, such as actuators, switches, and sensors. The impact of SCO transitions on thermal transport, however, has received limited attention.

Figure 2:
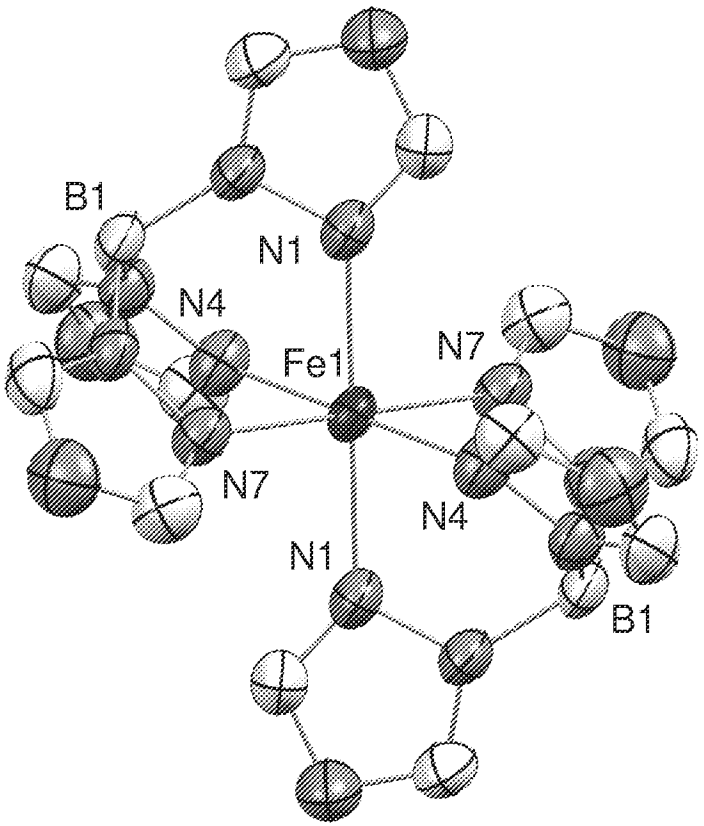
FIG. 2 shows bis[hydrotris(1,2,4-triazol-1-yl) borate] iron (II) ($Fe(HB(tz)_3)_2$) in the HS (right) and LS (left) states.
Figure 2:
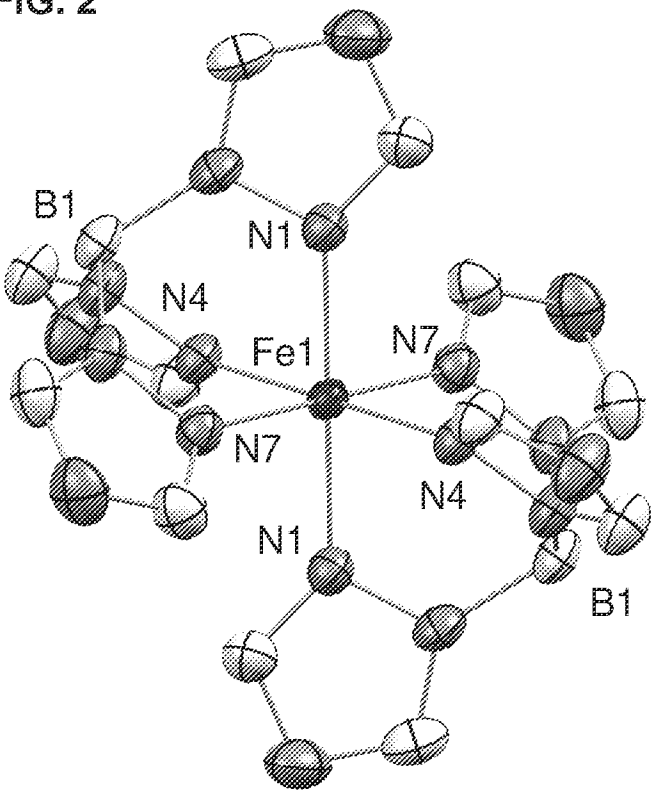

The invention employs materials that employ SCO as a mechanism for thermal conductivity switching. Various SCO materials are contemplated. For example, materials including transition metal coordination complexes where a transition metal has $d^4$-$d^7$ d-orbital occupancy. For example, materials including complexes of Co(ii), Co(iii) Fe(ii), Fe(iii), Ni(ii), Mn(ii), Mn(iii), Cr(ii), Pd(ii), Pt(ii), Au(i), Ag(i), or Cu(ii). Metal centers may be coordinated by one or more organic ligands, e.g., 1, 2, 3, 4, 6, 7 or 8. Organic ligands may bridge two or more metal coordination centers. SCO materials can be molecular (e.g., $Fe(HB(tz)_3)_2$) or, e.g., 1-, 2-, or 3-D materials (dimensionality refers to the dimensionality of covalent linkages between metals and bridging organic ligands). FIG. 2 shows the structure of $Fe(HB(tz)_3)_2$ in the low and high spin states. 2-D and 3-D materials may be porous, e.g., metal-organic frameworks (MOFs). Other SCO materials, e.g., those known in the art, are also contemplated.

Figure 3:
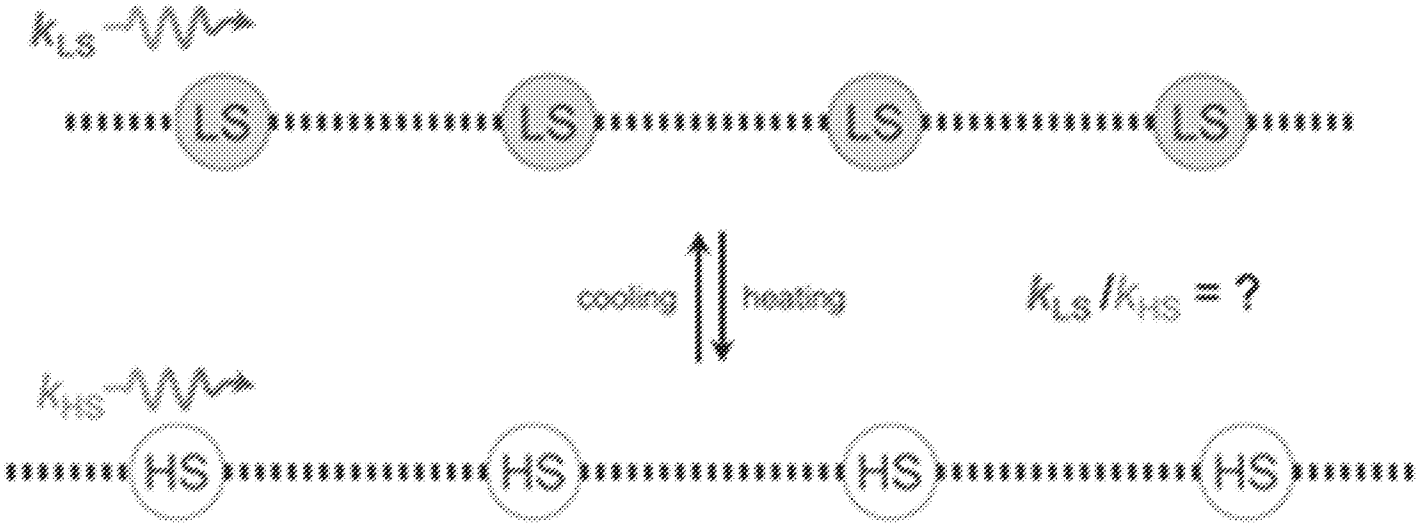
FIG. 3 is an illustration of SCO-induced change in thermal conductivity in 1-D triazole-based coordination polymer.

In some embodiments, the SCO materials are coordination polymers, e.g., one-dimensional 1-D coordination polymers of group 1 transition metals, e.g., as shown in FIG. 3. For example, complexes of Co(ii), Co(iii) Fe(ii), Fe(iii), Ni(ii), Mn(ii), Mn(iii), Cr(ii), Pd(ii), Pt(ii), Au(i), Ag(i), or Cu(ii). For example, one-dimensional (1-D) polymers of transition metals bridged by triazole (R-Trz) ligands, e.g., $[Fe(R\text{-}Trz)_3][A]_2$, where $Fe^{2+}$ metal centers are bridged by triazole. These 1-D metal-organic chains may be further connected through, e.g., intrachain interactions, e.g., hydrogen-bond interactions, e.g., involving charge-balancing anions (A). SCO polymers are advantageous for use as thermal control materials, because i) spin transitions can involve a substantial change in phonon density of states and the rigidity of lattice and ii) the phase transition kinetics of spin crossover is often fast.

SCO complexes may include a variety of suitable organic ligands, e.g., bridging ligands. Ligands may include organic molecules having one or more groups which form a bond (or bonds) with a transition metal center. Ligands may be chelators, i.e., forming more than one bond to the metal center per molecule, e.g., ligands may be bidentate, tridentate, quadridentate, etc. Ligands may include hydrocarbyl (e.g., alkyl), aryl, carbocyclyl, or heteroaryl groups. Ligands may bridge metal centers with other metal centers, e.g., in 1-D, 2-D, or 3-D lattices. Ligands may include groups which interact with other ligands in the solid-state, e.g., hydrocarbyl (e.g., alkyl) chains, H-bond donors and acceptors, pi-stacking aryl or heteroaryl groups, etc.

SCO materials of the invention may be in a variety of forms e.g., crystals, liquid crystals, gels, nanoparticles, glasses, thin films, etc.

The bulk conductivity of the SCO materials may be optimized by tuning of interchain interactions, e.g., through controlling the ligand functional groups and anions. For example, 1-D SCO polymers, e.g., $[Fe(R\text{-}Trz)_3][A]_2$, can access a tremendous structural and chemical diversity through judicious selection of the ligand moieties (e.g., functional modification of the four available positions in the triazoles(Trz) ligands), and/or, e.g., the charge-balancing anions. The triazole-based 1-D coordination polymers display a number of SCO properties—transitions in ambient temperature, synthetic tunability, fast switching kinetics, versatility—that are highly beneficial for thermal conductivity switching. As these transitions can be further manipulated by external stimuli (e.g., light and pressure), these SCO materials can be used as thermal switches, regulators, etc.

Stimuli

LS-to-HS transitions, which can be triggered by, e.g., electric or magnetic field, heating, and/or photoexcitation, can induce large changes in lattice properties, such as an increase in metal-ligand (M-L) bond length (~0.2 Å) and unit cell volumes (~10%), as well as decrease in elastic moduli (10-50%), sound velocity (~20%) and Debye temperature ($\theta_D$) (5-10%). The invention typically makes use of materials in which the thermal conductivity (k) of the low spin state ($k_{LS}$) is higher than that of the high spin state ($k_{HS}$).

Figure 4A:
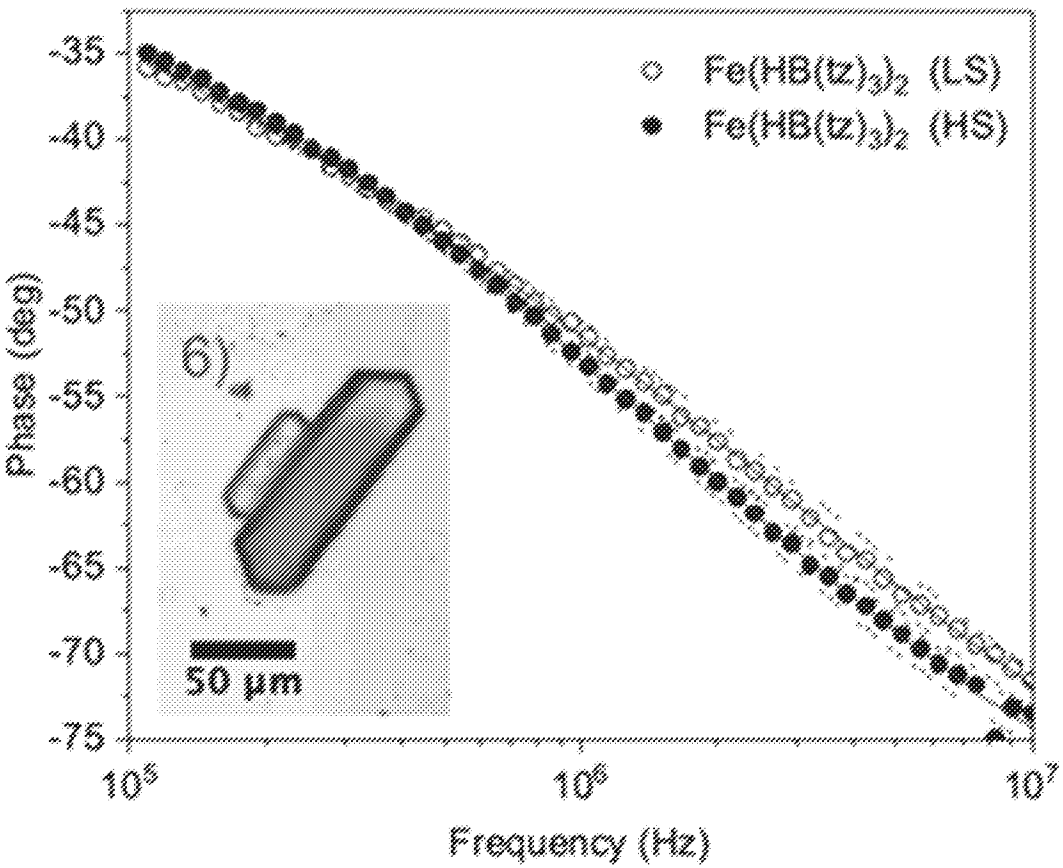
FIGS. 4A and 4B show thermal properties of crystalline bis[hydrotris(1,2,4-triazol-1-yl)borate] iron(II) ($Fe(HB(tz)_3)_2$) in the HS and LS states.
Figure 4B:
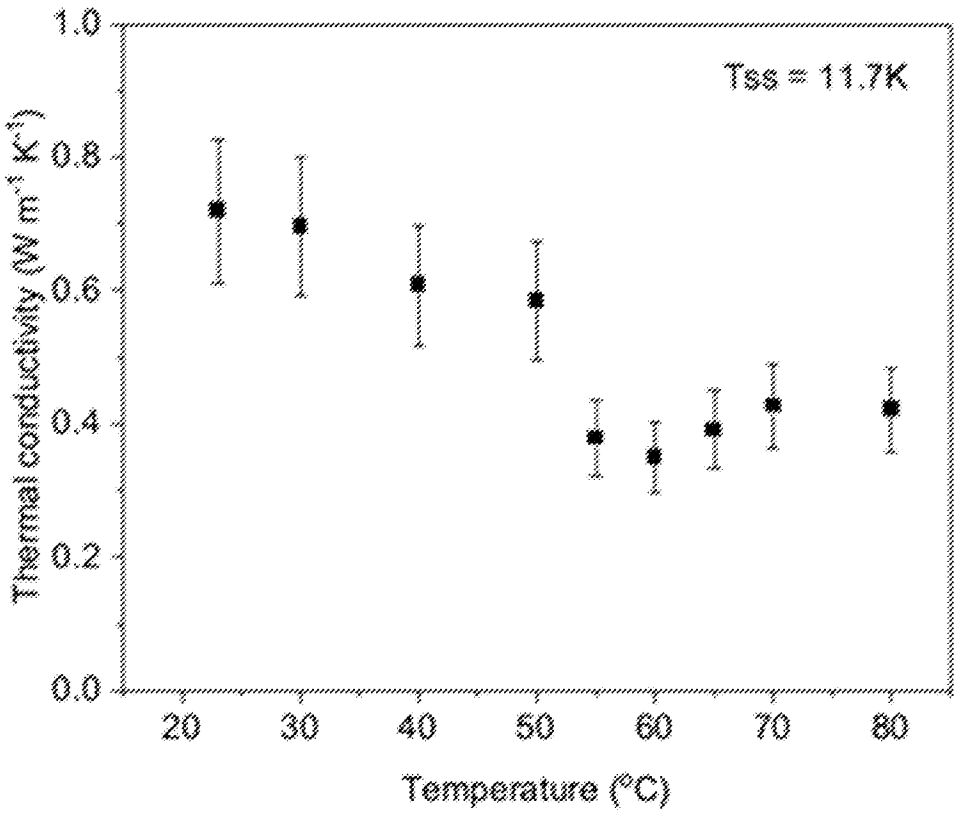

Spin transitions can be induced thermally or, e.g., by pressure, magnetic field, electric field, or light (e.g., photoswitchable ligands, metal-to-ligand charge transfer, ligand-to-metal charge transfer, or metal-based excitation). FIGS. 4A-4B show data on the change in conductivity of $Fe(HB(tz)_3)_2$ between the low and high spin states. Pressure may be used to prevent spin crossover, or the phase transitions associated with the spin crossover transition. For example, a spin crossover material may be held at a high pressure to prevent the transition while the material is at a temperature at which the transition would otherwise occur. Applying a lower pressure may then form part of the stimulus to induce the transition. Spin crossover transitions induced by light may occur at a specific wavelength, thereby providing highly selective activation of the transition. Light may be in or outside the visible spectrum, e.g., visible, UV, near IR, far IR, microwave, etc. Spin transitions, e.g., those induced by light, magnetic field, or electric field, may be mediated by another material, e.g., a scintillator or photocatalyst. In porous 2-D and 3-D materials (e.g., MOFs), spin transitions may be induced by the adsorption or desorption of guest molecules. Adsorption and desorption induced spin transitions may be coupled to other stimuli, e.g., those described herein.

Methods

Methods of the invention may include providing a device or system including a spin crossover material. The spin crossover material may be disposed to separate a high temperature volume or material and a low temperature volume or material and regulate heat flow therebetween by changing spin state by the application of a stimulus or stimuli (e.g., light, pressure, temperature, etc.). Methods may include, e.g., allowing heat energy to pass through a spin crossover material in the low spin state, e.g., to allow a phase transition in a caloric material or to store energy in a heat sink, and then applying a stimulus to induce transition to the high spin state to prevent the backflow of heat energy, e.g., during heat storage or release (e.g., for cooling or pumping operations).

Methods of the invention may include providing or removing heat energy (e.g., from a room, an AC system, heat transfer medium, heat pump, heat sink, etc.) to a device including a thermal switch of the invention (e.g., a heat pump, cooling system (e.g., a solid-state cooling system), heat storage/scavenging system, etc.).

Systems and Additional Components

Systems of the invention may utilize spin crossover materials for, e.g., thermal control of spacecraft, switchable insulation for building thermal control, caloric energy conversion (cooling, heat pumping, power generation, etc.), cryogenic thermal management (e.g., thermal management of cryogenically operated scientific equipment, e.g., in space), thermoelectric energy conversion, clothing thermal regulation, thermal energy storage, or thermal analogs of electrical circuits.

Systems of the invention may include components to provide compressive force to the composition, e.g., pumps, pistons, actuators (e.g., mechanical, hydraulic, or pneumatic, etc., actuators), presses (e.g., mechanical, hydraulic, or pneumatic, etc., presses), piezoelectric actuators, levers, etc. Systems may also include components to transfer or remove heat energy, e.g., pumps, heat sinks, thermoelectrics, fans, chiller pumps, etc. A system of the invention may also include a power source, e.g., to power the source of compressive force, the cooling or heat transfer components, etc.

Systems of the invention may be insulation systems, for example building or electrical insulation systems that allow heat to flow out when the system is too warm and prevent the outflow of heat when the system is too cool.

Methods, devices, and systems of the invention may be used in solid state cooling systems, e.g., including a caloric material, e.g., an electrocaloric, magnetocaloric, or barocaloric material. In solid-state cooling systems, a caloric capable of undergoing reversible phase transitions in response to a stimulus is in a thermal energy cycle is heated to undergo the transition and a stimulus is applied to allow the release of latent heat stored in the higher energy phase. For example, in a barocaloric cooling system or method, providing compression to the composition releases latent heat in the composition, which may be removed, e.g., via a heat sink, e.g., a high surface area, high conductivity medium in thermal contact with the composition which may be itself cooled by, e.g., a fan. Removal of the heat is performed while the composition is still compressed, and removal of the compression allows the composition to return to a disordered state, cooling the composition as the endothermic transition occurs. At this point the cycle may be repeated with input of new heat energy.

In a barocaloric thermal energy storage system heat energy is provided to a composition of the invention causing it to undergo a phase transition to a disordered state. The disordered state is then modified by the application of compression in order to change the temperature at which heat is released.

Spin crossover materials may be used in methods, devices, and systems of the invention, for example, to prevent unwanted backflow of heat energy during the release of latent heat by the caloric material. For example, the pressure induced changes in spin state may be complementary to the phase changes of a barocaloric material.

Other embodiments are in the claims.

What is claimed is:

1. A method of controlling the flow of heat comprising:

a) providing a device comprising a spin crossover material having a low spin state and a high spin state, wherein the low spin state has higher thermal conductivity than the high spin state, and wherein the spin crossover material undergoes spin crossover between the low and high spin states in response to a stimulus;

b) providing a temperature difference across the spin crossover material; and c) applying the stimulus to control the flow of heat across the spin crossover material.

2. The method of claim 1, wherein the stimulus applied is a pressure change, a temperature change, a magnetic field, an electric field, light, or any combination thereof.

3. The method of claim 1, wherein step (c) comprises increasing or decreasing a temperature of the spin crossover material to a temperature at which the spin crossover material undergoes spin crossover.

4. The method of claim 1, wherein (b) further comprises maintaining the low spin state by applying a first pressure while providing the temperature difference to allow heat to flow across the spin crossover material and step (c) comprises applying a second pressure which allows the spin crossover material to undergo spin crossover to the high spin state to reduce heat flow across the spin crossover material.

5. The method of claim 4, further comprising applying a second stimulus to change the spin crossover material to the low spin state.

6. A method of storing heat energy, comprising:

a) providing a device or system comprising:

i) a spin crossover material having a low spin state and a high spin state, wherein the low spin state has higher thermal conductivity than the high spin state, and wherein the spin crossover material undergoes spin crossover between the low spin state and high spin state in response to a first stimulus and between the high spin state and low spin state in response to a second stimulus; and ii) a heat sink in thermal contact with the spin crossover material;

b) flowing heat energy from a heat source through the spin crossover material into the heat sink while the spin crossover material is in the low spin state;

c) applying the first stimulus to switch the material to the high spin state to store the heat energy.

7. The method of claim 6, further comprising:

d) applying the second stimulus to switch the spin crossover material to the low spin state thereby releasing the heat energy.

8. The method of claim 6, wherein the first stimulus and/or second stimulus is a pressure change, a temperature change, a magnetic field, an electric field, light, or any combination thereof.

9. The method of claim 6, wherein the first or second stimulus comprises increasing or decreasing a temperature of the spin crossover material to a temperature at which the spin crossover material undergoes spin crossover.

10. The method of claim 6, wherein step (b) further comprises maintaining the low spin state by applying a first pressure and step (c) comprises applying a second pressure which allows the spin crossover material to undergo spin crossover to the high spin state.

11. A method of heating or cooling, comprising:

a) providing heat energy to a caloric material through a spin crossover material having a low spin state and a high spin state, wherein the low spin state has higher thermal conductivity than the high spin state, and wherein the spin crossover material undergoes spin crossover between the low spin state and high spin state in response to a first stimulus and between the high spin state and low spin state in response to a second stimulus, wherein the heat energy is provided while the spin crossover material is in the low spin state;

b) applying the first stimulus to switch the spin crossover material to the high spin state;

c) inducing the caloric material to release the heat energy; and d) applying a second stimulus to the spin crossover material to change to the low spin state.

12. The method of claim 11 wherein the first stimulus and/or second stimulus is a pressure change, a temperature change, a magnetic field, an electric field, light, or any combination thereof.

13. The method of claim 11, wherein the first or second stimulus is a temperature change.

14. The method of claim 13, wherein step (a) further comprises maintaining the low spin state by applying a first pressure while providing a temperature difference to allow heat to flow across the spin crossover material and step (b) further comprises applying a second pressure which allows the spin crossover material to undergo spin crossover to the high spin state.

15. A device for controlling heat flow comprising a spin crossover material having a low spin state and a high spin state, wherein the low spin state has higher thermal conductivity than the high spin state, and wherein the spin crossover material undergoes spin crossover between the low spin state and high spin state in response to a first stimulus.

16. The device of claim 15, wherein the first stimulus is a pressure change, a temperature change, light, or any combination thereof.

17. The device of claim 16, wherein the spin crossover induced by the first stimulus can be reversed by a second stimulus.

18. The device of claim 15, wherein the spin crossover material comprises a transition metal coordination complex.

19. The device of claim 18, wherein the transition metal coordination complex comprises Co(ii), Co(iii) Fe(ii), Fe(iii), Ni(ii), Mn(ii), Mn(iii), Cr(ii), Pd(ii), Pt(ii), Au(i), Ag(i), Cu(ii), or a combination thereof.

20. The device of claim 15, wherein the spin crossover material comprises a molecular transition metal complex or a 1-D, 2-D, or 3-D polymeric transition metal complex.

21. The device of claim 20, wherein the spin crossover material comprises the 1-D polymeric transition metal complex and the 1-D polymeric transition metal complex comprises bridging triazole ligands.

22. The device of claim 15, wherein the spin crossover material comprises 1-D polymeric $[Fe(R\text{-}Trz)_3][A]_2$, wherein R-Trz is a triazole ligand with an R group, wherein each R group is independently H, an optionally substituted hydrocarbyl group, an optionally substituted aryl, an optionally substituted carbocyclyl group, or an optionally substituted heteroaryl group, and A is an anion or combination of anions.

23. The device of claim 15, wherein the spin crossover material is bis[hydrotris(1,2,4-triazol-1-yl)borate] iron(II) ($Fe(HB(tz)_3)_2$).

* * * * *